US007375298B2

(12) United States Patent
Kurek et al.

(10) Patent No.: US 7,375,298 B2
(45) Date of Patent: May 20, 2008

(54) INDEXING MECHANISM

(75) Inventors: Stephen R. Kurek, Rego Park, NY (US); Emma Levin, Brooklyn, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 121 days.

(21) Appl. No.: 11/078,078

(22) Filed: Mar. 11, 2005

(65) Prior Publication Data

US 2005/0230229 A1 Oct. 20, 2005

Related U.S. Application Data

(60) Provisional application No. 60/553,834, filed on Mar. 17, 2004.

(51) Int. Cl.
*H01H 13/62* (2006.01)

(52) U.S. Cl. ..... 200/17 R; 200/565; 74/813 R

(58) Field of Classification Search ..... 200/17 R, 200/564–570, 400, 401, 500, 501, 330, 331; 74/63, 96, 470, 479.01, 480 R, 491
See application file for complete search history.

(56) References Cited

U.S. PATENT DOCUMENTS 3,596,013 A * 7/1971 Pihl ..... 200/1 R
3,767,880 A * 10/1973 Austin ..... 200/318
3,789,701 A * 2/1974 Ditzig ..... 74/813 R
3,965,755 A * 6/1976 Rosenberg et al. ..... 74/10 R
4,390,761 A * 6/1983 Introvigne ..... 200/426
4,460,296 A * 7/1984 Sivertson, Jr. ..... 408/124
4,706,727 A * 11/1987 Leivenzon et al. ..... 160/188
4,857,677 A * 8/1989 Tanaka et al. ..... 200/5 R
4,891,476 A * 1/1990 Nation et al. ..... 200/11 R
5,072,078 A * 12/1991 Rao et al. ..... 200/11 R
5,609,244 A * 3/1997 Reiter ..... 200/43.11
5,893,685 A * 4/1999 Olson et al. ..... 408/35
6,196,076 B1 * 3/2001 Chung ..... 74/22 A

* cited by examiner

*Primary Examiner*—Elvin Enad
*Assistant Examiner*—M. Fishman
(74) *Attorney, Agent, or Firm*—Paul J. Sutton

(57) ABSTRACT

An indexing mechanism with positive ON and OFF positions for a motor starter switch mounted in an NEMA 3R enclosure. The indexing mechanism includes a shaft having longitudinally extending projections coupled in fixed relationship to a handle, an index element coupled to the shaft, and a yoke having a pin positioned to engage the index element to positively position the shaft to the first or the second position.

7 Claims, 11 Drawing Sheets

INDEXING MECHANISM

This application claims the benefit of the filing date of a provisional application having Ser. No. 60/553,834 which was filed on Mar. 17, 2004.

BACKGROUND OF THE INVENTION

An electrical device, such as an electrical motor, typically requires a switch mechanism to control power to the device. The switch mechanism may include an electrical switch coupled to a user accessible mechanical actuator such as a handle. If the switch mechanism is used in an industrial environment, it may be mounted in an enclosure to provide personnel safety and equipment protection. An example of an enclosure is a type 3R enclosure specified by the national electrical manufacturers association (NEMA) which provides a forum for the standardization of electrical equipment. However, the switch mechanism may exhibit "play" as it is rotated to a first or second position (e.g., ON or OFF).

What is needed is a switch mechanism that provides a positive index or "feel" when it is moved between positions.

SUMMARY OF THE INVENTION

The present invention overcomes the disadvantages of the prior art by providing an indexing mechanism that provides positive ON and OFF positions for an electrical device such as a motor starter switch mounted in a NEMA 3R enclosure. The indexing mechanism is economical to produce and provides positive indexing handle positions for starting and stopping a motor. Moreover, the indexing mechanism provides a user with a positive ON and OFF "feel," substantially eliminates "play" in the handle when in the ON and OFF positions, and prevents switch "hang up" in mid-travel.

In one embodiment, the present invention provides an indexing mechanism that includes a shaft having longitudinally extending projections coupled in fixed relationship to a handle, an index element coupled to the shaft, and a yoke having a pin positioned to engage the index element and to positively position the shaft to the first or the second position.

The above stated and other embodiments and advantages of the invention will become more apparent from the following detailed description when taken with the accompanying drawings. It will be understood, however, that the drawings are for the purposes of illustration and are not to be construed as defining the scope or limits of the invention, references being had for the latter purpose to the claims appended hereto.

BRIEF DESCRIPTION OF THE DRAWINGS

Preferred embodiments of the present application are described herein with reference to the drawings in which similar elements are given similar reference characters, wherein.

DETAILED DESCRIPTION

The present invention provides an indexing mechanism with positive ON and OFF positions for an electrical device such as a motor starter switch to be mounted in a NEMA 3R enclosure. The indexing mechanism is economical to produce and provides positive indexing handle positions for starting and stopping a motor. Moreover, the indexing mechanism provides a user with a positive ON and OFF "feel," substantially eliminates "play" in the handle when in the ON and OFF position, and prevents switch "hang up" in mid-travel.

Figure 1:
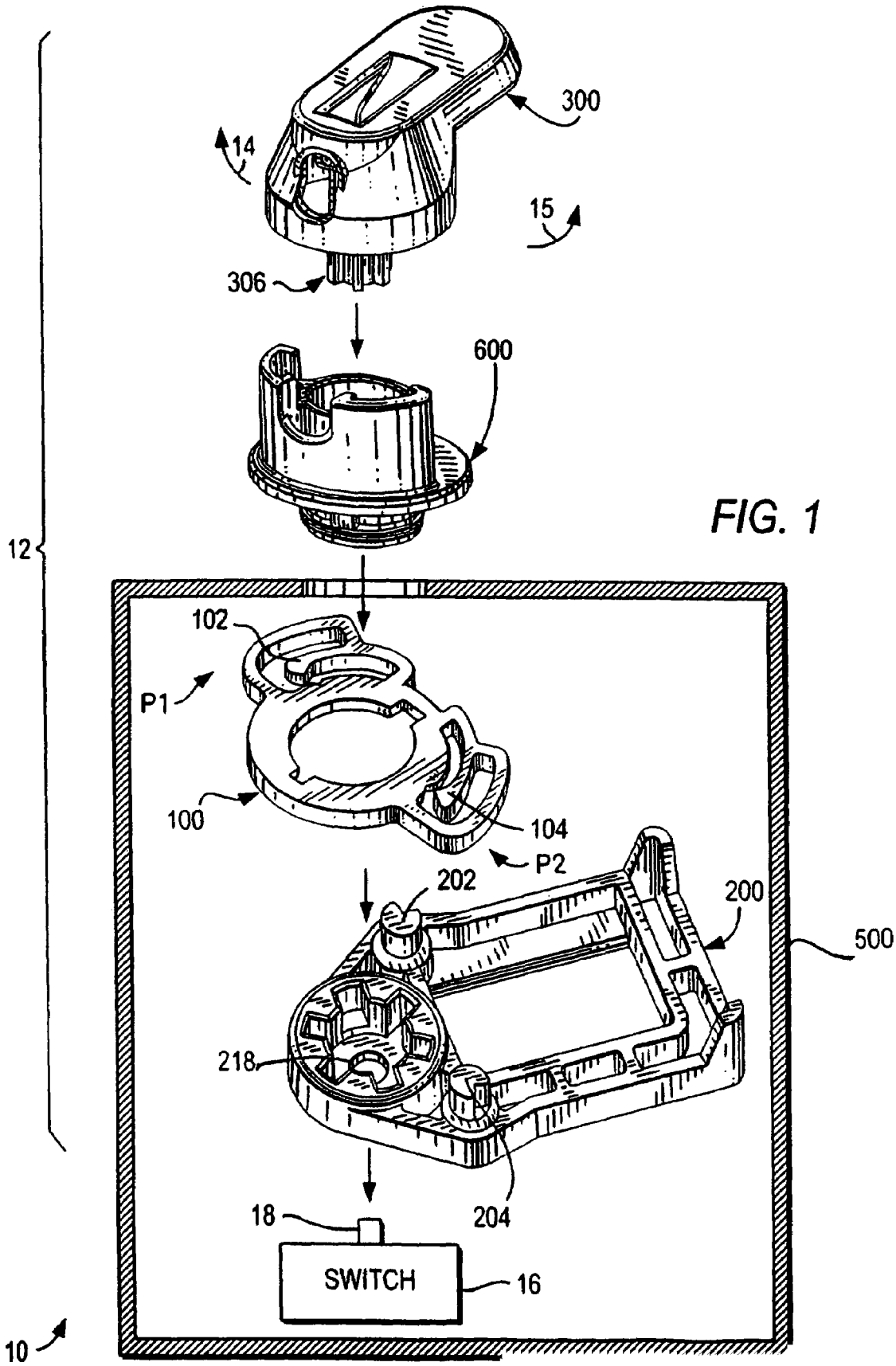
FIG. 1 is an exploded view of a switch mechanism according to an embodiment of the invention.

Referring to FIG. 1, shown is an exploded view of an assembly that includes an electrical switch mechanism 10 having an enclosure 500 for mounting an indexing mechanism 12 rotatable between a first position P1 and a second position P2 to control an ON/OFF switch 16. The indexing mechanism 12 includes a handle 300 with a shaft 306 which extends through a central opening of a bushing 600, a central opening of an index element 100 and a recess 218 of a yoke 200, and is fixedly coupled to the yoke 200. The recess 218 includes a central opening at its bottom to allow a portion of the shaft 306 to be fixedly coupled to an actuator 18 of the switch 16. The switch 16 can be an electromechanical switch for controlling (ON and OFF) an electrical device (not shown) such as an electrical motor or other device. The bushing 600 and the index element 100 are fixedly coupled to enclosure 500 and do not rotate whereas the handle 300 and the yoke 200 can rotate. That is, a rotation of the handle 300 causes a rotation of the yoke 200 whereas the bushing 600 and the index element 100 remain fixed.

In particular, a rotation of the handle 300, shown as arrow 14, causes a rotation of the yoke 200 so that a first pin 202 of the yoke 200 engages a first pawl 102 of the index element 100 to provide a positive detent or index for a first position P1. See also FIG. 7A for a bottom view. In a similar manner, a rotation of the handle 300, shown as arrow 15, causes a rotation of the yoke 200 so that a second pin 204 of the yoke 200 engages a second pawl 104 of the index element 100 to provide a positive detent or index for a second position P2. See also FIG. 7B for a bottom view. The index mechanism 12 is coupled to drive the switch 16 to its ON position when the mechanism is in the second position P2, and drive the switch 16 to its OFF position when the mechanism is in the OFF position. Moving the indexing mechanism 12 to its first position P1 or its second position P2, drives the switch 16 to its ON or OFF position to control an electrical device such as a motor.

Figure 2A:
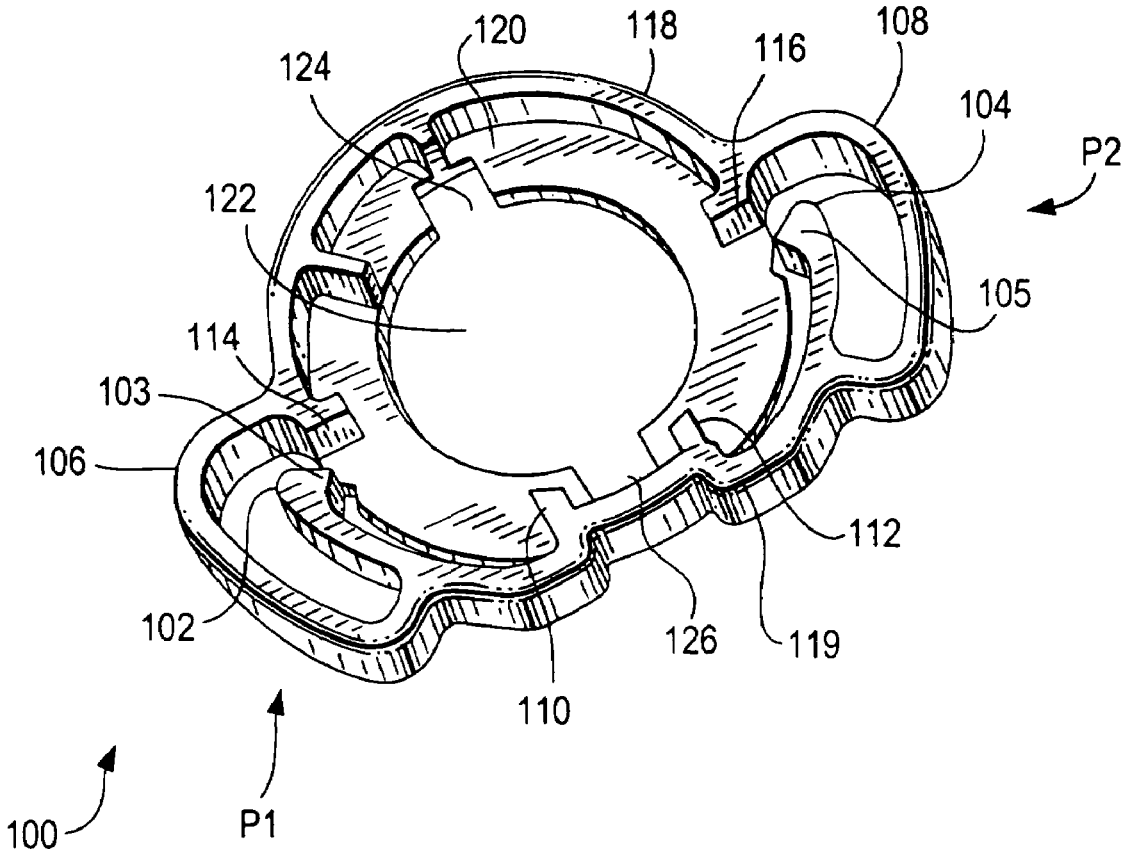
FIG. 2A is a bottom perspective view of an index element of the switch mechanism of FIG. 1.
Figure 2B:
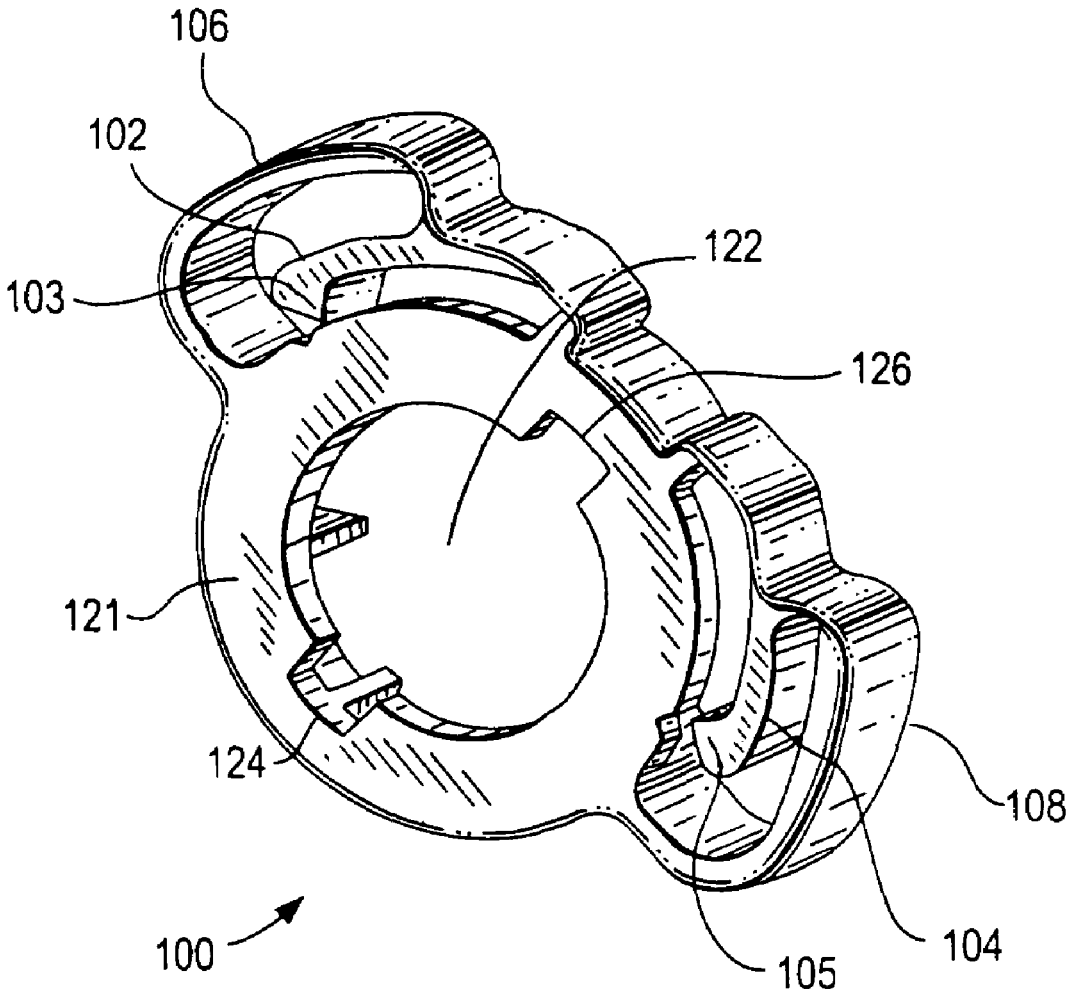
FIG. 2B is a top perspective view of the index element of FIG. 2A.

FIG. 2A is a bottom perspective view and FIG. 2B is a top perspective view of the index element 100 of the indexing mechanism 12 of FIG. 1. As explained above, the index element 100 is capable of providing a positive detent for a first position P1 of the handle 300 defined by the location of the first pawl 102 into engagement with the first pin 202, and a second position P2 of the handle defined by the location of the second pawl 104 into engagement with the second pin 204. The first pawl 102 has a first end with a protrusion 103 shaped to match and engage a depression of the first pin 202 of the yoke 200 (FIG. 1) and a second end fixed to a left side of the index element 100. The first pawl 102 is flexible to allow it to move back and forth. In one embodiment, the protrusion 103 is generally V shaped but any other shape can be selected to be compatible with the depression of the first pin 202. Like the first pawl 102, the second pawl 104 has a similar shape (e.g., protrusion 105) and function as the first pawl 102 except that it is fixed to the right side the index element 100.

In one embodiment, the index element 100 is a generally a circular shaped plate or ring having a top surface 121 and a bottom surface 120 and a centrally located opening 122 to rotatably accept the shaft 306 of the handle 300 (FIG. 1). Referring to FIG. 2A, there is a shown a generally circular upper rib 118 formed around the perimeter of an upper portion and lower portion and a generally circular lower rib 119 formed on the bottom surface 120. A first lobe shaped rib 106 is formed on a left side of the element 100 extending away from the opening 122 and providing an opening to allow the first pawl 102 to flex. Likewise, in a symmetrical manner to the first lobe rib 106, a second lobe shaped rib 108 is formed on the right side of the element 100 extending away from the opening 122 and providing an opening to allow the second pawl 104 to flex.

An upper notch 124 is formed on an upper portion of the index element 100 and a lower notch 126 is formed on a lower portion of the element. The notches 124, 126 are shaped to engage respective mounting tabs 604, 606 of bushing 600 (FIG. 5) and to fix the index element 100 to the enclosure 500 (FIG. 1) and prevent the index element 100 from rotating when the handle 300 is rotated. For the first position P1, a first upper stop tab 114 extends from the left side of the upper rib 118 and a first lower stop tab 110 extends from the left side of the lower rib 119 where the distance between the tabs 110, 114 define the rotational limits between which the first pin 202 can be moved. In a similar manner, for the second position P2, a second upper stop tab 116 extends from the right side of the upper rib 118 and a second lower stop tab 112 extends from the right side of the lower rib 119 where the distance between the tabs 112, 116 define the rotational limits between which the second pin 204 can be moved. The rotational limits or displacements for positions P1 and P2 are substantially equal.

Figure 3A:
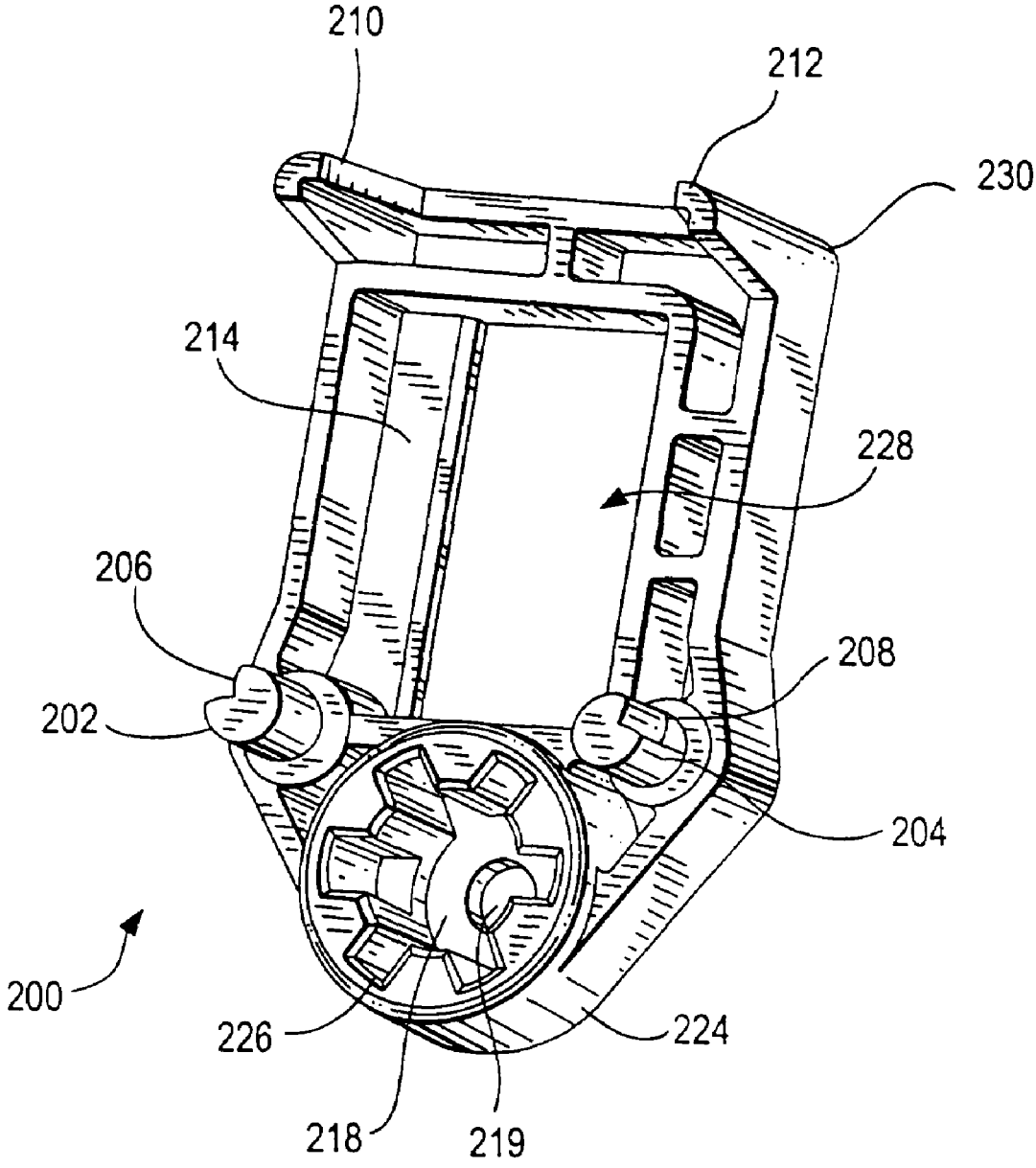
FIG. 3A is a top perspective view of a yoke of the switch mechanism of FIG. 1.
Figure 3B:
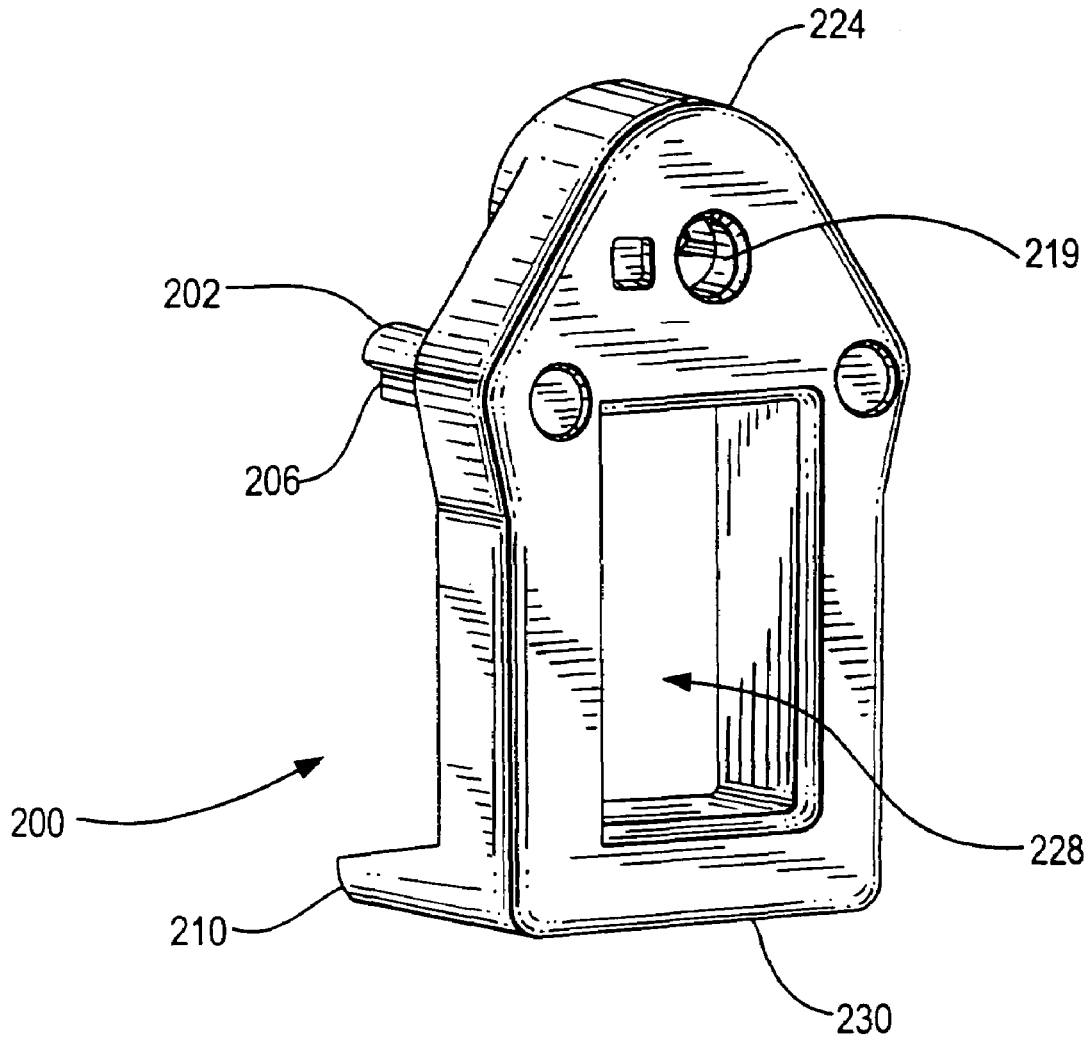
FIG. 3B is a bottom perspective view of the yoke of FIG. 3A.

FIG. 3A is a top perspective view and FIG. 3B is a bottom perspective view of the yoke 200. In one embodiment of the invention, the yoke 200 is a unitary member having at one end a generally rectangular shaped body portion 230 and at its other end a generally triangular shaped portion 224. The yoke 200 includes a centrally located rectangular opening 228 and a pair of legs 210, 212 extending upward from a surface 214 of the yoke 200 near the outer edge of the body portion 230. The first pin 202 extends upward from a surface of the yoke 200 near the outer edge of the body portion 224. The first pin 202 has a first notch 206 shaped to engage the index element 100 (FIG. 2A). Like the first pin, the second pin 204 extends from a surface of the yoke 200 near the outer edge of the body portion 224. In one embodiment, the first notch 206 is V shaped which extends longitudinally along the length of the first pin 202 to engage the V shaped protrusion 103 of the first pawl 102 of the index element 100 (FIG. 2A). The second pin 204 is located opposite the first 202 pin and has a structure and function similar to the first pin. For example, the second pin 204 has a V shaped notch 208 which extends longitudinally along the length of the pin to engage the V shaped protrusion 105 of the second pawl 104 of the index element 100 (FIG. 2A).

Figure 4A:
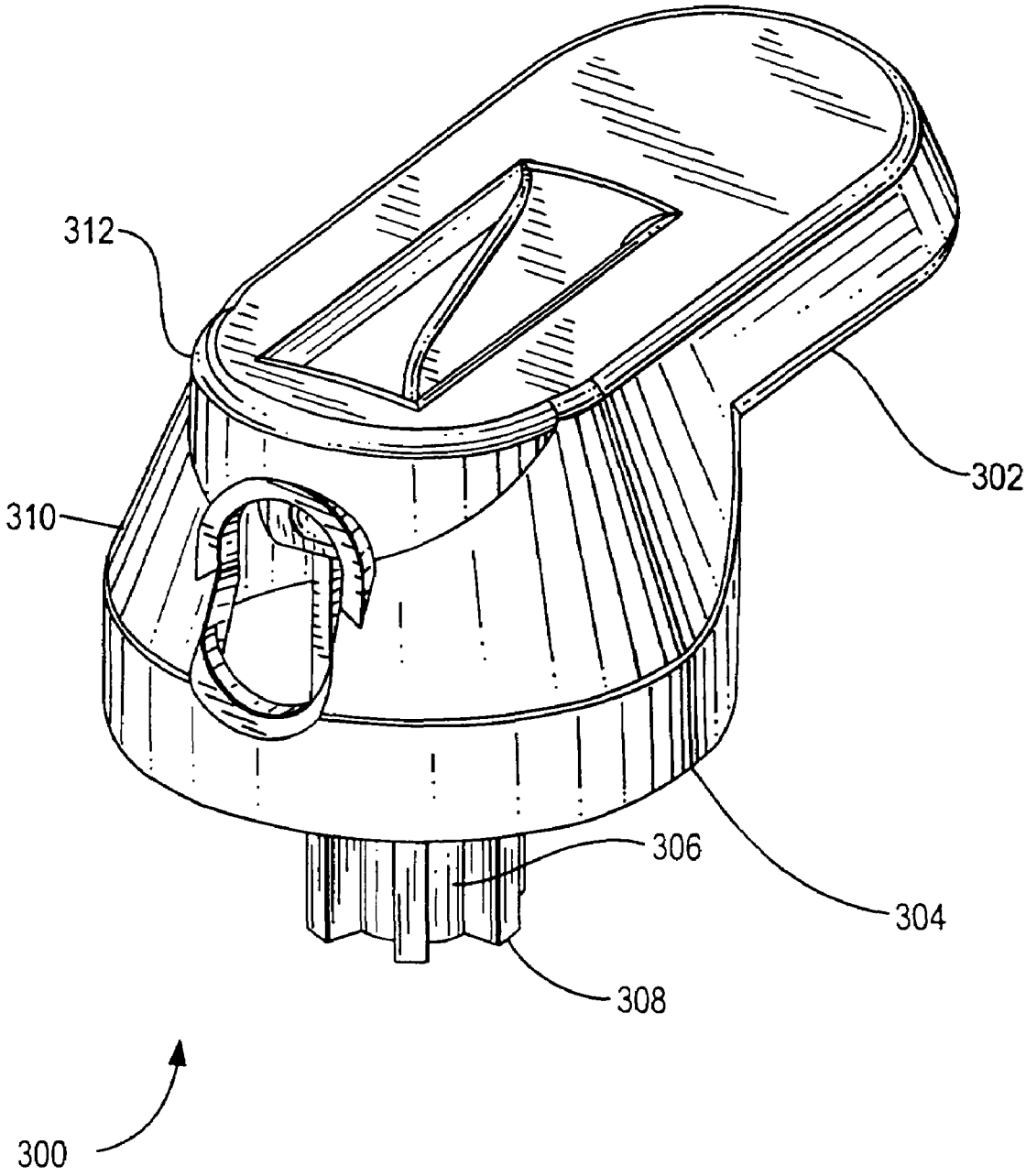
FIG. 4A is a top perspective view of a handle of the switch mechanism of FIG. 1.

The recess 218 is centrally formed in the triangular body portion 224 and located between the first pin 202 and the second pin 204. The recess 218 includes a plurality of rectangular shaped notches 226 positioned around the periphery of the recess and a depth substantially equal to that of the recess to snuggly and fixedly engage the rectangular projections 308 of the handle 300 (FIG. 4A). For example, referring to FIG. 3A, shown are 6 rectangular shaped notches 226 but any other number of notches can be used. The recess 218 includes a central opening 219 for allowing a base or bottom portion of the shaft 306 to project therethrough to engage the actuator 18 of the switch 16 (FIG. 1).

Figure 4B:
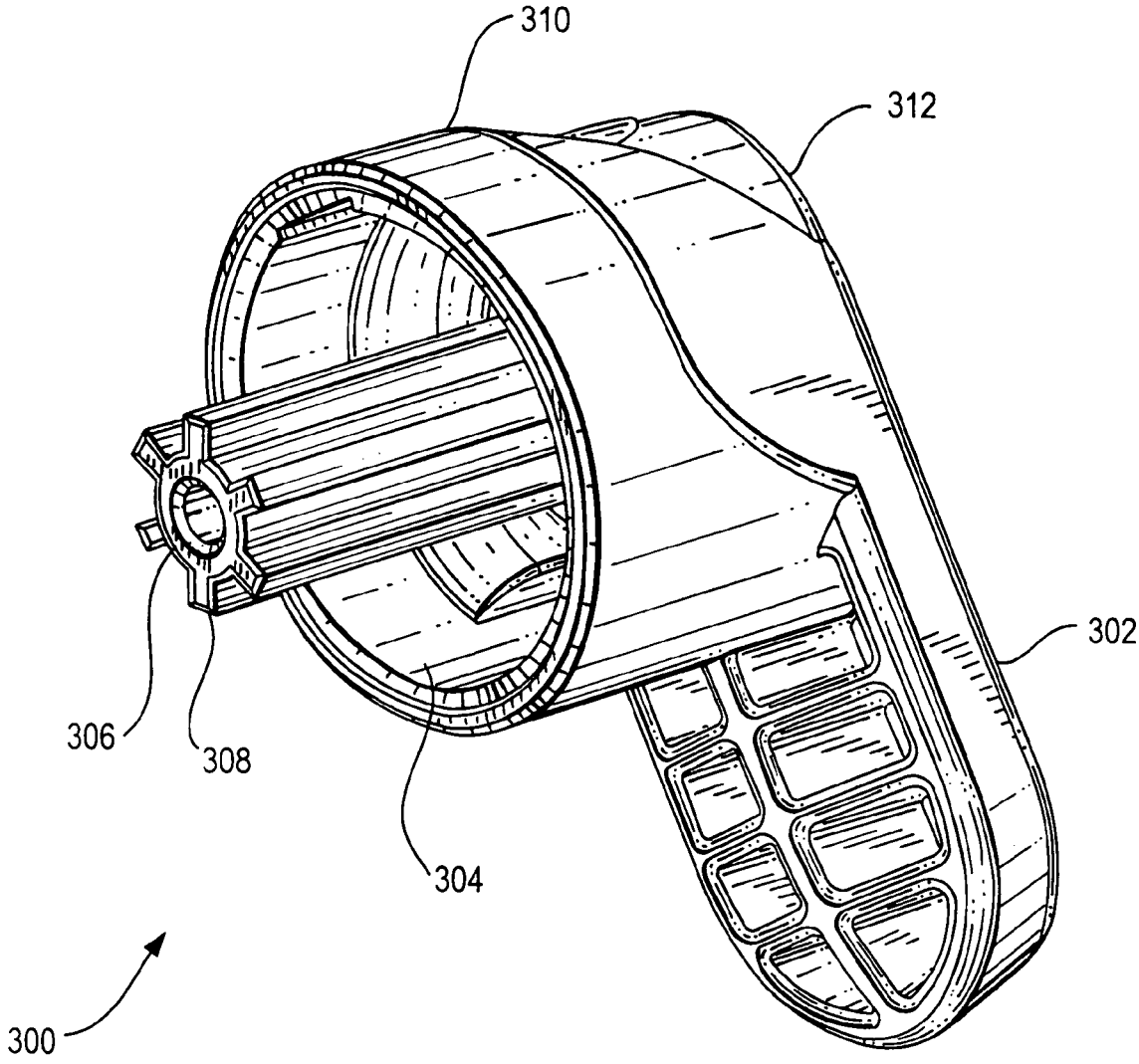
FIG. 4B is a bottom perspective view of the handle of FIG. 4A.

FIG. 4A is a top perspective view and FIG. 4B is a bottom perspective view of the handle 300 of the indexing mechanism of FIG. 1. In one embodiment of the invention, the handle 300 has a generally circular main body 310 with a closed top portion 312 and an open bottom portion 304. A grip portion 302 extends transversely from the top portion 312 to allow a user to grip and rotate the handle 300. The shaft 306 extends from the top closed portion 312 and out through the open bottom portion 304 to be received by the recess 218 of the yoke 200 (FIG. 1). The rectangular shaped projections 308 extend longitudinally along the shaft 306 and outward from the center of the shaft 306 and are shaped to fit snuggly and fixedly within the notches 226 of the yoke 200 (FIG. 3A). Shown are 6 rectangular shaped projections 308 but any other number of projections can be used.

Figure 5:
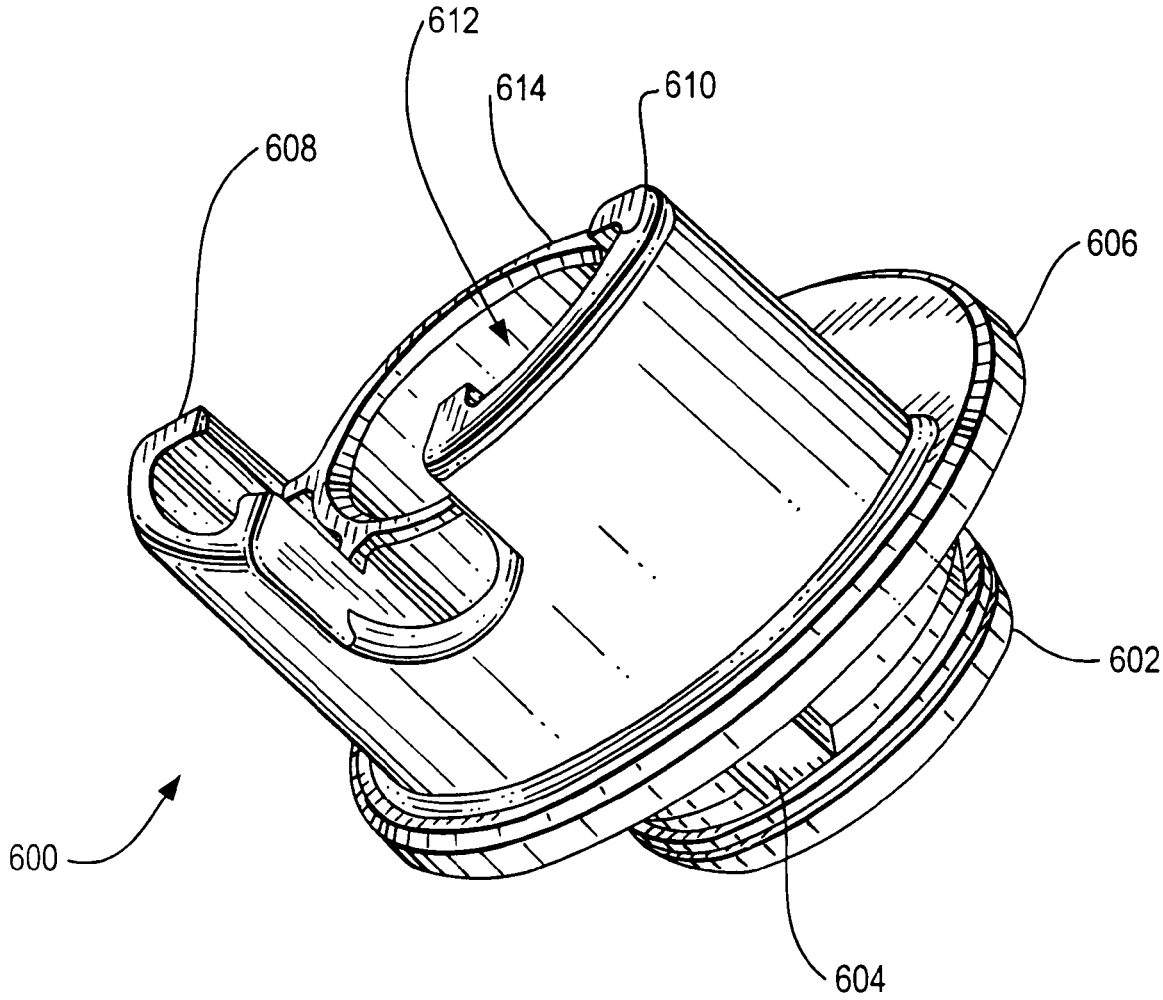
FIG. 5 is a top perspective view of a bushing of the switch mechanism of FIG. 1.

FIG. 5 is a top perspective view of the bushing 600 of the indexing mechanism of FIG. 1. In one embodiment of the invention, the bushing 600 allows the handle 300 (FIG. 1) to rotate freely about the bushing 600 and seals the enclosure 500 from the external environment. The bushing 600 is fixedly coupled to the enclosure 500 and rotatably coupled to the shaft 306 of the handle 300. The bushing 600 supports a cylindrical member having a generally circular disc 606 and a centrally located opening 612. Opening 612 accommodates the shaft 306 of the handle 300 (FIG. 4B) and the outside diameter of the disc 606 is greater than the diameter of the opening 502 of the enclosure 500 (FIG. 6) to fit over the opening 502 and seal the enclosure 500.

Figure 6:
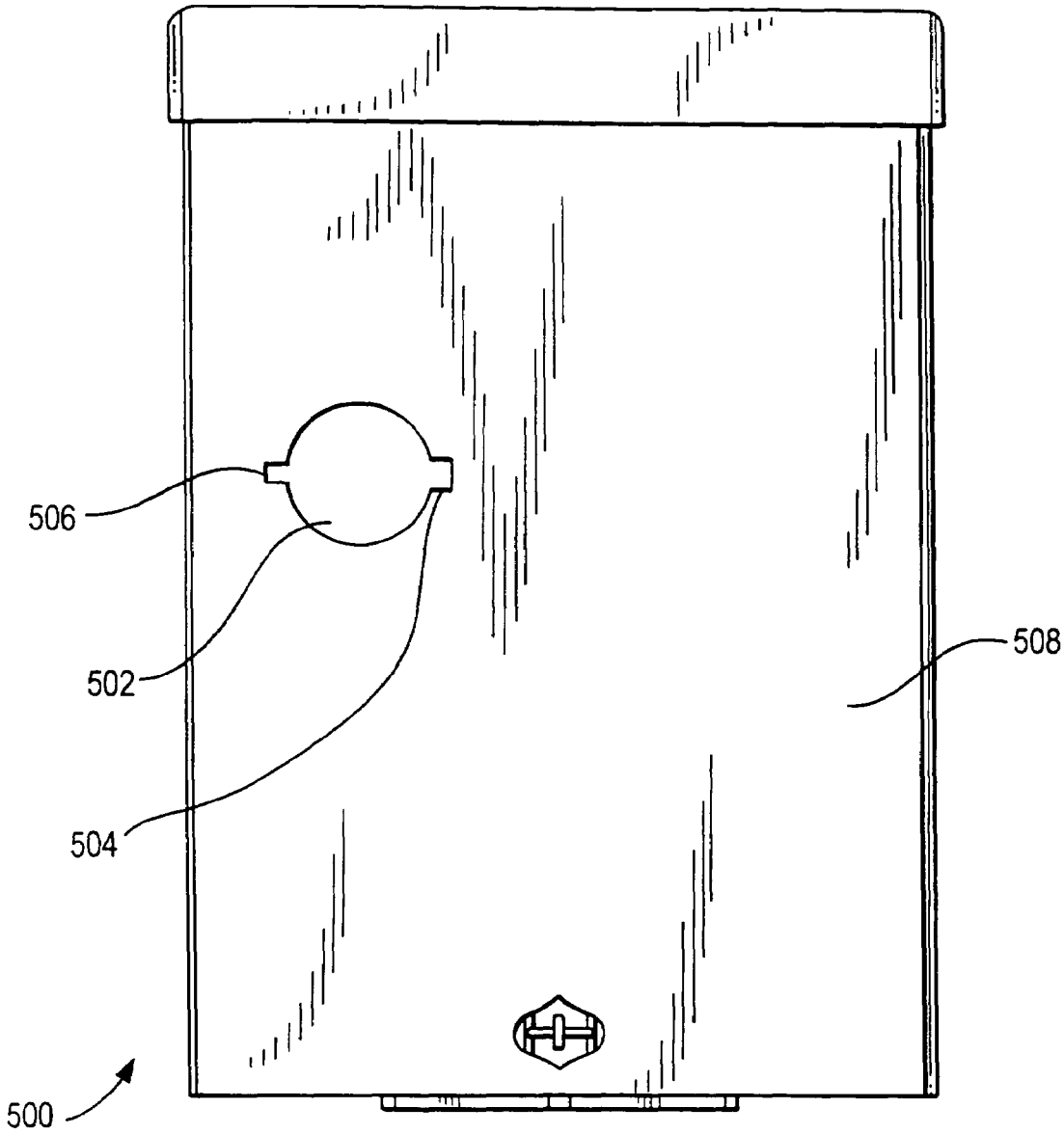
FIG. 6 is a top view of an enclosure for use with the switch mechanism of FIG. 1.

A first concentric rim 614 is formed around the perimeter of the top surface of the cylinder and has a diameter sufficient to receive the shaft 306 of the handle. A pair of spaced tabs 608, 610 extend from the top surface of the rim 614 to fit within opening 304 of the handle 300 (FIG. 4B) and be fixedly coupled to the handle 300. A second concentric rim 602 is formed around a bottom surface of the cylinder 606 and has a diameter which can be inserted into the opening 502 of the enclosure 500 (FIG. 6). A generally rectangular shaped first mounting tab 604 and a generally rectangular second mounting tab (not shown) formed opposite the first tab 604 extend outward from the second rim 602 for positioning within the notches 504, 506 of the enclosure 500 (FIG. 6).

FIG. 6 is a top view of the enclosure 500 for mounting the indexing mechanism of FIG. 1. In one embodiment, the enclosure 500 has a top surface 508 (bottom and side surfaces are not shown) with the opening 502 having a diameter to accommodate the bushing 600 (FIG. 5) and notches 504, 506 to receive and fixedly couple the bushing 600 to the enclosure 500. In one embodiment, the enclosure is a NEMA 3R enclosure but the indexing mechanism of the present invention can be mounted to any other type of enclosure.

Figure 7A:
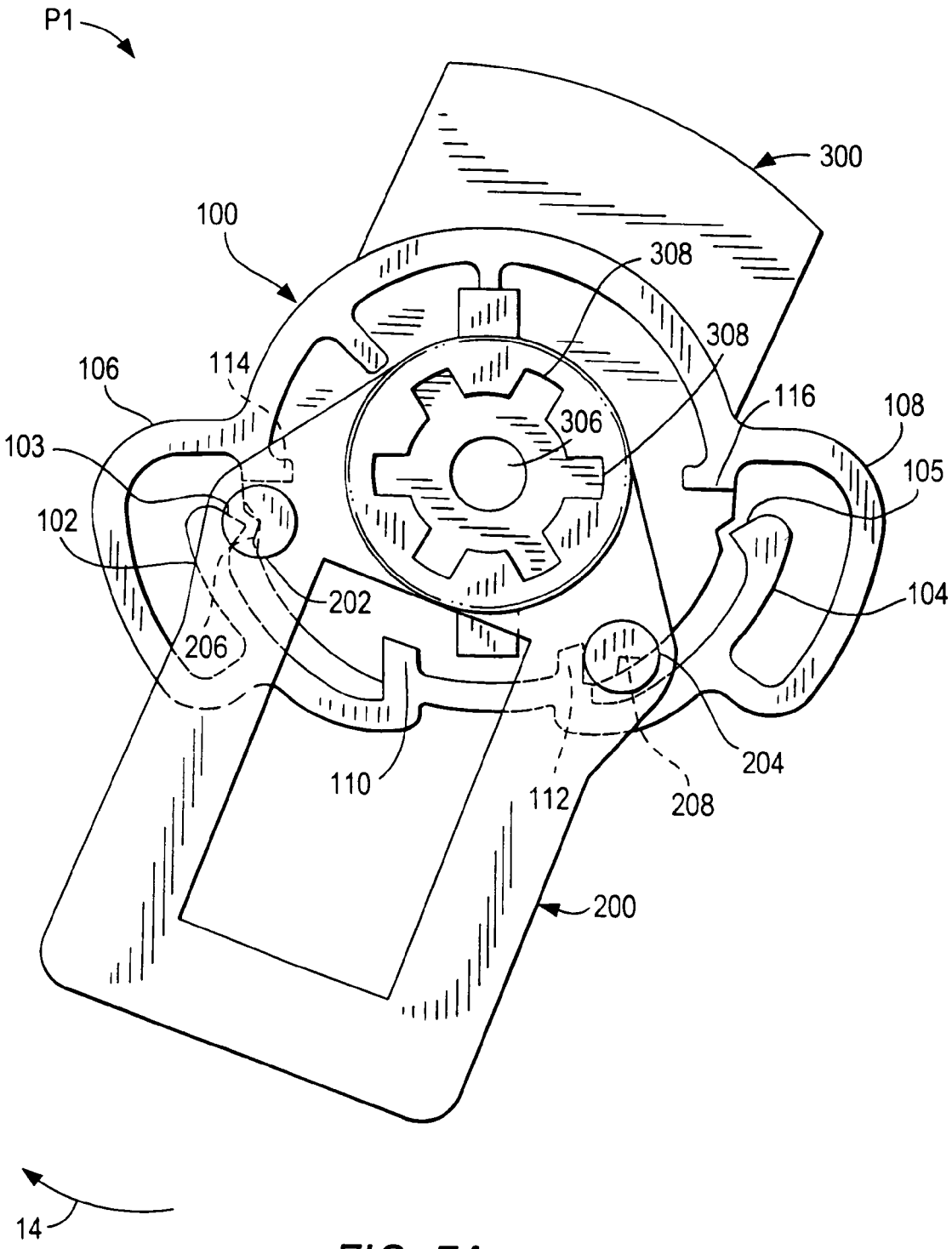
FIG. 7A is a bottom view of the yoke of FIG. 3A in a first position.
Figure 7B:
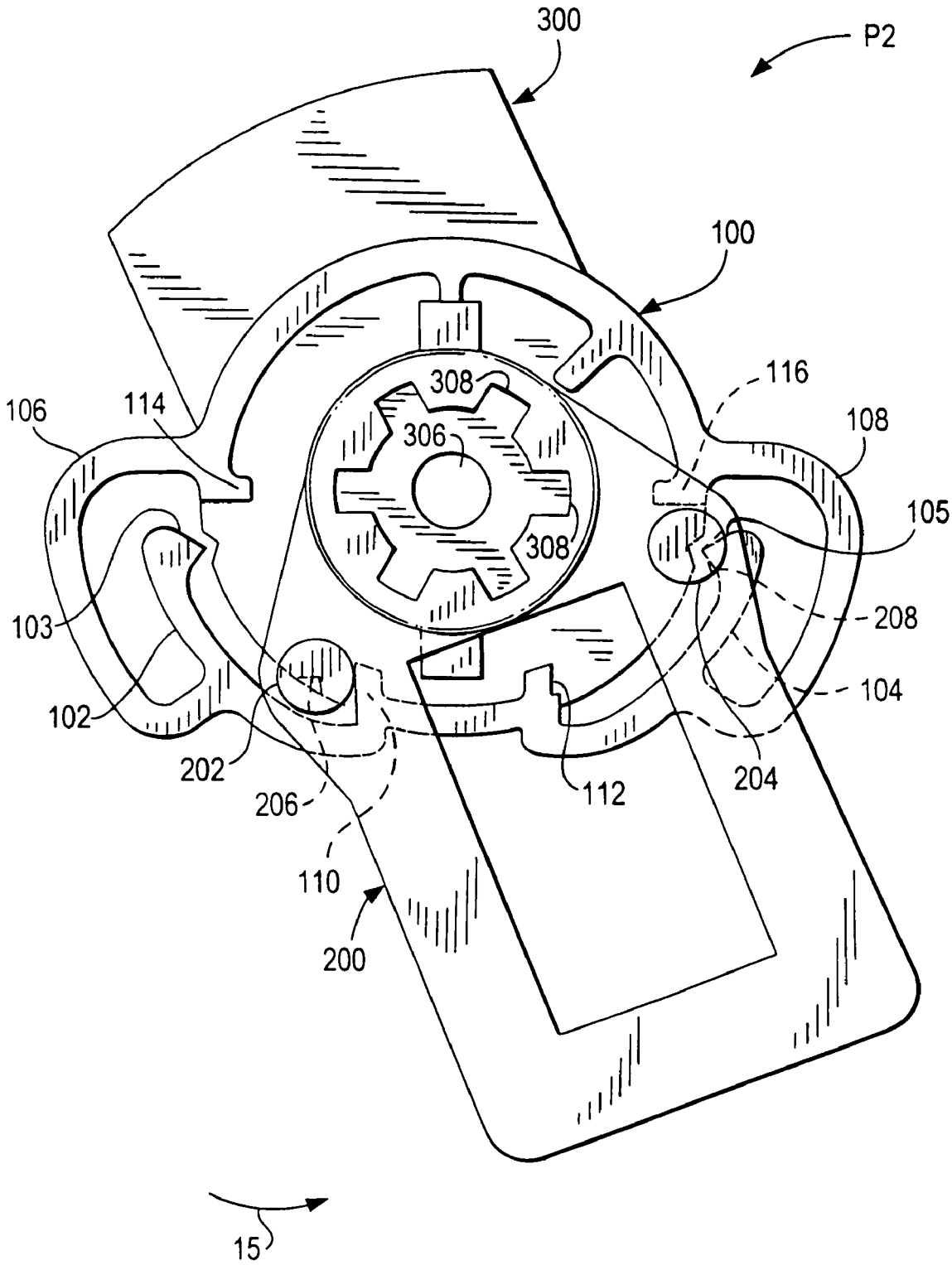
FIG. 7B is a bottom view of the yoke of FIG. 3A in a second position.

FIGS. 7A and 7B are bottom views of the indexing mechanism 12 of FIG. 1 in a first position P1 and a second position P2, respectively. Referring to FIG. 7A, the shaft 306 is fixedly coupled to the yoke 200 via the projections 308 of the handle. The shaft 306 is also rotatably coupled to the index element 100. In operation, when the handle 300 is rotated, as shown by arrow 14, the first pin 202 moves away from stop tab 110 and advances toward the first pawl 102. As the first pin 202 is further advanced, it engages the protrusion 103 of the first pawl 102 causing the first pin to push or flex the first pawl 102 outward and away from the center of the index element 100. As the first pin 202 advances further, the pointed portion of the V shaped protrusion 103 is captured by the notch 206 of the first pin 202 to cause the first pawl 102 to move inward toward the center of the index element. When disengaging the first pawl 102 from the first pin 202, a certain amount of force is needed to overcome the inward force exerted by the first pawl 102 on the first pin 202. The stop tab 114 helps prevent the first pin 202 from advancing beyond the first position P1. In addition, the stop tab 112 helps prevent the second pin 204 from advancing any further.

Referring to FIG. 7B, the operation of the indexing mechanism for the second position P2 is similar to the operation of the indexing mechanism for the first position P1 except that the direction of rotation of the handle for position P2 is opposite to that of position P1. For example, when the handle 300 is rotated, as shown by arrow 15, the second pin 204 moves away from the stop 112 and advances toward the second pawl 104 until the second pin 204 and the second pawl 104 engage. This functions in a manner similar to the first pin 202 and the first pawl 102. When disengaging the second pawl 104 from the second pin 204, a certain amount of force is necessary to overcome the inward force or bias exerted by the second pawl 104 on the second pin 204. The stop tab 116 helps prevent the second pin 204 from advancing beyond the first position P1. In addition, the stop tab 110 helps prevent the first pin 202 from advancing any further.

Thus, this arrangement provides a positive index and helps reduce "play" in the handle. Now that the handle 300 and the shaft 306 are positively indexed in first and second positions, a switch can be configured to turn ON/OFF a motor or other electrical device depending on the application.

Although the invention is described in the context of first and second positions, one skilled in the art would appreciate that the invention can be applied to a plurality of positions and to applications other than an ON/OFF switch such as a consumer or industrial electrical device. The components of the index mechanism 12 can be fabricated from plastic, metal or a combination thereof. The indexing mechanism has been described as providing indexing function performed by an indexing arrangement of pawls 102, 104, and pins 202, 204. However, it should be understood that the indexing function can be performed by other arrangements such as a notch shaped to capture or accept a spring based ball bearing pin or other configurations.

While there have been shown and described and pointed out the fundamental features of the invention as applied to the preferred embodiment as is presently contemplated for carrying thereout, it will be understood that various omissions and substitutions and changes of the form and details of the device described and illustrated and in its operation may be made by those skilled in the art, without departing from the spirit of the invention.

What is claimed is:

1. An indexing mechanism for providing positive first and second positions to control an ON/OFF switch, the indexing mechanism comprising:

a shaft having longitudinally extending projections coupled in fixed relationship to a handle;

an index element coupled to the shaft; and a yoke coupled to receive the shaft, the yoke having a pin positioned to engage the index element to positively position the shaft to the first or the second position, wherein the index element has a first and second pawl and the yoke is coupled to receive the shaft, a first pin of the yoke is positioned to engage the first pawl to positively position the shaft to the first position, and a second pin is positioned to engage the second pawl to positively position the shaft to the second position wherein the index element includes a first pair of stop tabs to define rotational limits between which the first pin can move, and a second pair of stop tabs to define rotational limits between which the second pin can move.

2. The indexing mechanism of claim 1, further comprising a bushing fixedly coupled to the index element.

3. The indexing mechanism of claim 1, wherein the yoke includes a centrally located opening having notches shaped for fixedly coupling to the longitudinally extending projections of the shaft.

4. The indexing mechanism of claim 1, wherein the indexing mechanism is adapted to be mounted to a National Electrical Manufacturers Association (NEMA) enclosure.

5. The indexing mechanism of claim 1, wherein the handle is user accessible.

6. The indexing mechanism of claim 1, wherein the index element includes mounting notches for fixedly coupling to an enclosure.

7. The indexing mechanism of claim 6, wherein the enclosure is a National Electrical Manufacturers Association enclosure.

* * * * *